US009316419B2

(12) United States Patent
Gerlach

(10) Patent No.: US 9,316,419 B2
(45) Date of Patent: Apr. 19, 2016

(54) EXPANDER SYSTEM

(75) Inventor: David W. Gerlach, Ellington, CT (US)

(73) Assignee: Carrier Corporation, Farmington, CT (US)

( * ) Notice: Subject to any disclaimer, the term of this patent is extended or adjusted under 35 U.S.C. 154(b) by 232 days.

(21) Appl. No.: 13/984,042

(22) PCT Filed: Jan. 23, 2012

(86) PCT No.: PCT/US2012/022152

§ 371 (c)(1),
(2), (4) Date: Aug. 7, 2013

(87) PCT Pub. No.: WO2012/134608

PCT Pub. Date: Oct. 4, 2012

(65) Prior Publication Data

US 2013/0312452 A1 Nov. 28, 2013

Related U.S. Application Data

(60) Provisional application No. 61/470,335, filed on Mar. 31, 2011.

(51) Int. Cl.
*F25B 11/02* (2006.01)
*F04B 45/02* (2006.01)
(Continued)

(52) U.S. Cl.
CPC ..... *F25B 11/02* (2013.01); *F04B 45/02* (2013.01); *F04B 45/022* (2013.01); *F04B 45/0336* (2013.01); *F25B 9/06* (2013.01); *F25B 1/10* (2013.01); *F25B 2309/061* (2013.01)

(58) Field of Classification Search
CPC .... F04B 45/02; F04B 45/022; F04B 45/0336; F04B 19/04; F04B 19/24; F01B 23/00; F01B 23/08; F01B 31/00; F01B 31/06; F25B 9/06; F25B 11/02; F25B 2309/061; F04C 9/00; F04C 9/002; F04C 9/005; F04C 9/007; F04C 21/00; F04C 21/002; F04C 21/005; F04C 21/007; F04C 23/00; F04C 5/00
See application file for complete search history.

(56) References Cited

U.S. PATENT DOCUMENTS 355,634 A * 1/1887 Baldwin et al. ..... F02G 1/043 60/519
2,330,151 A 9/1943 Smith
(Continued)

FOREIGN PATENT DOCUMENTS

DE 19813220 * 9/1999 ..... F25B 1/10
DE 19813220 A1 9/1999
DE 10242271 B3 1/2004

OTHER PUBLICATIONS

International Search Report and Written Opinion for PCT/US2012/022152, dated Nov. 21, 2012.
(Continued)

*Primary Examiner* — Mohammad M Ali
*Assistant Examiner* — Christopher R Zerphey
(74) *Attorney, Agent, or Firm* — Bachman & LaPointe, P.C.

(57) ABSTRACT

An apparatus (20) has a compressor (22), heat rejection heat exchanger (30), heat absorption heat exchanger (60), and expansion-compression device (40; 200). The expansion-compression device couples the heat absorption heat exchanger to the heat rejection heat exchanger and to the compressor. The expansion-compression device comprises first (80A), second (80B), third (80C), and fourth (80D) variable volume chambers and a pivoting member. The pivoting member (98) is mounted for reciprocal rotation in opposite first and second directions about an initial orientation and is coupled to the chambers so that: rotation from the initial orientation in the first direction expands the first and third chambers and compresses the second and fourth chambers; and rotation from the initial orientation in the first second direction compresses the second and third chambers and expands the second and fourth chambers.

11 Claims, 7 Drawing Sheets

(51) Int. Cl.

| | |
|---|---|
| ***F04B 45/033*** | (2006.01) |
| ***F25B 9/06*** | (2006.01) |
| *F25B 1/10* | (2006.01) |

(56) References Cited

U.S. PATENT DOCUMENTS

| | | | | | |
|---|---|---|---|---|---|
| 2,359,819 | A | * | 10/1944 | Bachrach | 417/481 |
| 3,668,884 | A | * | 6/1972 | Nebgen | 62/228.5 |
| 4,246,959 | A | | 1/1981 | Byrne | |
| 4,312,181 | A | | 1/1982 | Clark | |
| 5,073,094 | A | | 12/1991 | Dorman et al. | |
| 5,375,430 | A | | 12/1994 | Siegel | |
| 5,381,675 | A | | 1/1995 | Siegel | |
| 5,950,707 | A | * | 9/1999 | Kozacka et al. | 165/9 |
| 6,332,323 | B1 | | 12/2001 | Reid et al. | |
| 6,725,670 | B2 | | 4/2004 | Smith et al. | |
| 7,143,586 | B2 | | 12/2006 | Smith et al. | |
| 7,159,416 | B2 | | 1/2007 | Park | |
| 2007/0257766 | A1 | | 11/2007 | Richards et al. | |
| 2008/0184717 | A1 | | 8/2008 | Sienel et al. | |
| 2011/0061412 | A1 | * | 3/2011 | Bayram | 62/222 |

OTHER PUBLICATIONS

Y. Ma et al., Thermodynamic Analysis and Comparison of Expander for CO2 Transcritical Cycle, IIR/IIF-Commission B1, B2, E1 and E2, Sep. 17, 2012, pp. 287-292, Guangzhou, China.

P. Heyl et al., Free Piston Expander-Compressor for CO2-Design, Applications and Results, 20th International Congress of Refrigeration, IIR/IIF, Sep. 19, 1999, vol. III (Paper 516), Sydney, Australia.

J. Riha et al., Integration of an Expander/Compressor into a Supermarket CO2 Cooling System, IIR Gustav Lorentzen Conference on Natural Working Fluids, May 28-31, 2006, Trondheim, Norway.

I.K. Smith, Development of the Trilateral Flash Cycle System, Part 1: Fundamental Considerations, Proceedings of the Institution of Mechanical Engineers, Part A: Journal of Power and Energy, Aug. 1993, pp. 179-194, vol. 207, No. 3, London.

H-J Huff et al., CO2 Compressor-Expander Analysis, Air-Conditioning and Refrigeration Technology Institute, ARTI-21CR/611-10060-01, Mar. 2003.

* cited by examiner

EXPANDER SYSTEM

CROSS-REFERENCE TO RELATED APPLICATION

Benefit is claimed of U.S. Patent Application Ser. No. 61/470,335, filed Mar. 31, 2011, and entitled "Expander System", the disclosure of which is incorporated by reference herein in its entirety as if set forth at length.

BACKGROUND

The disclosure relates to refrigeration. More particularly, the disclosure relates to use of expansion-compression devices in refrigeration cycles.

The isenthalpic expansion devices used in most vapor compression refrigeration cycles waste energy that could be recovered. Devices such as turbine and piston expanders can recover some of the expansion energy and use it for recompression.

SUMMARY

One aspect of the disclosure involves an apparatus having a compressor, heat rejection heat exchanger, heat absorption heat exchanger, and expansion-compression device. The expansion-compression device couples the heat absorption heat exchanger to the heat rejection heat exchanger and to the compressor. The expansion-compression device comprises first, second, third, and fourth variable volume chambers and a pivoting member. The pivoting member is mounted for reciprocal rotation in opposite first and second directions about an initial orientation and is coupled to the chambers so that: rotation from the initial orientation in the first direction expands the first and third chambers and compresses the second and fourth chambers; and rotation from the initial orientation in the first second direction compresses the first and third chambers and expands the second and fourth chambers.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
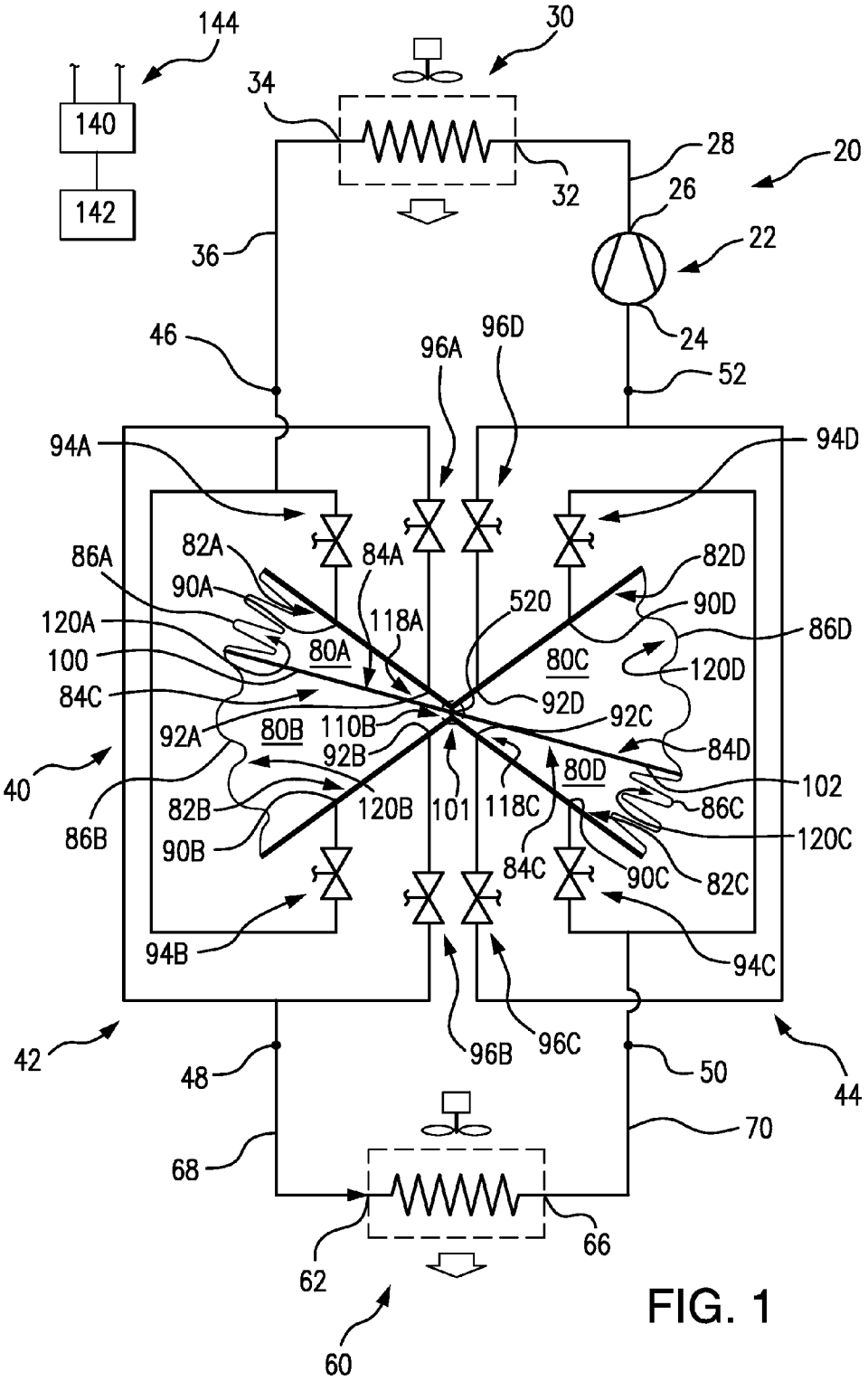
FIG. 1 is a partially schematic view of a refrigeration system.
Figure 2:
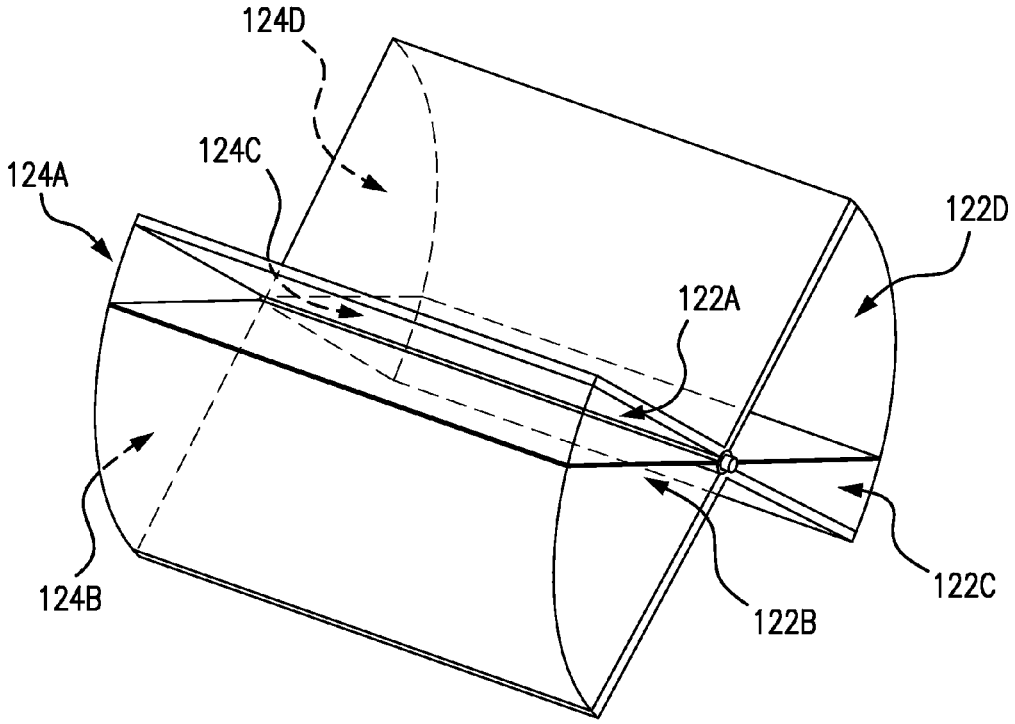
FIG. 2 is a partially schematic view of an expansion-compression device of the system of FIG. 1.

FIG. 1 shows a vapor compression system or apparatus 20 having a compressor 22. The compressor has a suction (inlet) port 24 and a discharge (outlet) port 26. A discharge line (conduit) 28 extends from the discharge port to an inlet 32 of a heat rejection heat exchanger 30 (e.g., a gas cooler in a transcritical $CO_2$ cycle). A refrigerant line 36 extends from the outlet 34 of the heat rejection heat exchanger.

The system further includes an expansion-compression device (expander) 40 having a first side (half) 42 and a second side (half) 44. The first side includes an inlet port 46 at the downstream end of the line 36. The first side further includes an outlet port 48. Similarly, the second side 44 includes an inlet port 50 and an outlet port 52. The outlet port 52 is coupled to a suction line 54 returning to the compressor suction port 24.

A heat absorption heat exchanger (evaporator) 60 is positioned between the ports 48 and 52. The evaporator has an inlet 62 and an outlet 64. The inlet 62 is coupled to the port 48 via a refrigerant line 66. The outlet 64 is coupled to the port 50 via a refrigerant line 70.

The first side 42 acts to expand and lower the temperature of refrigerant delivered to the evaporator so as to facilitate heat absorption in the evaporator. The second side 44 serves to pre-compress refrigerant passed from the evaporator to the compressor so as to reduce the pressure difference required of the compressor and thereby reduce energy consumption.

The exemplary expansion-compression device 40 has four variable volume chambers 80A-80D. The volumes of these chambers are mechanically linked to vary in synchronicity with each other. As is discussed further below, the exemplary chambers are formed as bellows structures, more particularly, hinged bellows structures wherein a wall of the chamber (e.g., a wall dividing two chambers) pivots about a hinge and, more particularly, where such walls separating respective pairs of chambers are hinged to co-rotate. Each chamber includes a first wall 82A-82D (collectively 82) and a second wall 84A-84D (collectively 84). A respective bellows structure 86A-86D (collectively 86) links the first and second walls to expand with expansion of the associated chamber and compressor contract with compression of the associated chamber. The exemplary first walls are fixed (non-moving); whereas the exemplary second walls move. Each exemplary chamber includes one or more ports (e.g., a first port 90A-90D (collectively 90) and a second port 92A-92D (collectively 92)). Flow through these ports is controlled by one or more valves. In the exemplary embodiment, flow through each port 90A-90D is controlled by a respective associated valve 94A-94D (collectively 94) and flow through each port 92A-92D is controlled by a respective associated valve 96A-96D (collectively 96). In alternative embodiments, the ports and/or valves may be combined in various fashions. The exemplary valves are basic two-port, on-off, electrically or electronically controllable, valves (e.g., solenoid valves) which may be controlled by a control system (controller) (discussed further below). For ease of viewing, reference will be made to an orientation shown in the drawings but not necessarily required in any particular implementation. As viewed in the drawings, the upper chamber 80A of the first side and lower chamber 80B of the second side may be identified as the first and second chambers of the first side. Similarly, the upper chamber 80C of the second side and the lower chamber 80D of the second side may respectively be identified as first and second chambers of the second side.

In the exemplary embodiment, the exemplary first walls 82 are flat and the walls 82A and 82C essentially coplanar to each other and the walls 82B and 82D essentially coplanar to each other and at angle $\theta_1$ to the walls 82A, 82C ($\theta_1$ being measured through the adjacent chambers). The exemplary second walls 84 are formed by a pivoting member 98 having a first portion 100 to a first side of a pivot 101 (e.g., a journaled shaft) and a second portion 102 to a second side of the pivot 101. The pivot 101 defines an axis of rotation 520 of the pivoting member 98. The exemplary pivoting member first portion 100 forms the walls 84A and 84B; whereas the second portion 102 forms the walls 84C and 84D. Each exemplary chamber 80 extends from a proximal end 118A-118D (collectively 118) near the pivot to a distal end 120A-120D (collectively 120). The exemplary chambers also have lateral sides 122A-122D and 124A-124D. The exemplary distal ends 120 are formed by associated portions 130A-130D of a bellows material of the respective bellows 86. Similarly, the sidewalls 122A-122D and 124A-124D are respectively formed by portions of bellows material 132A-132D and 134A-134D of the respective bellows 86.

As viewed in the orientation of FIG. 1, as the pivoting member 98 pivots counterclockwise about the axis 520, the first and third chambers expand and the second and fourth chambers contract/compress. It is noted that referencing the contraction/compression of a chamber does not necessarily require compression of refrigerant in the chamber. For example, if a chamber contracts/compresses while open to a low pressure condition, the refrigerant in and exiting the chamber may be expanding while the chamber contracts/compresses. As the pivoting member rotates clockwise (as viewed), the first and third chambers contract/compress while the second and fourth chambers expand. This mechanical linkage of the volumes of the chambers may be used to extract work from expansion of refrigerant entering inlet 46 and exiting outlet 48 and use that work to compress refrigerant entering inlet 50 and exiting outlet 52 to provide a pre-compression of refrigerant entering the compressor by an amount $\Delta P$. This pre-compression allows the compressor to provide a smaller pressure difference $\Delta P_C$ for a given system pressure difference $\Delta P$ between the high side pressure P1 at the heat exchanger 30 and the low side pressure P2 at the heat exchanger 60. Alternatively, the pre-compression may be used to allow a greater $\Delta P$ for a given $\Delta P_C$ or a combination. An exemplary $\Delta P_E$ is at least 5% of $\Delta P$, more narrowly, in excess of 10% (e.g., 10-50%). Especially for higher percentages (e.g., 50-90%), a multi-stage system may be used.

The controller 140 may receive user inputs from an input device 142 (e.g., switches, keyboard, or the like) and sensors (not shown). The controller 140 may be coupled to the controllable system components (e.g., the valves, the compressor motor, and the like) and system input devices (e.g., sensors, switches, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices system components.

Figure 3:
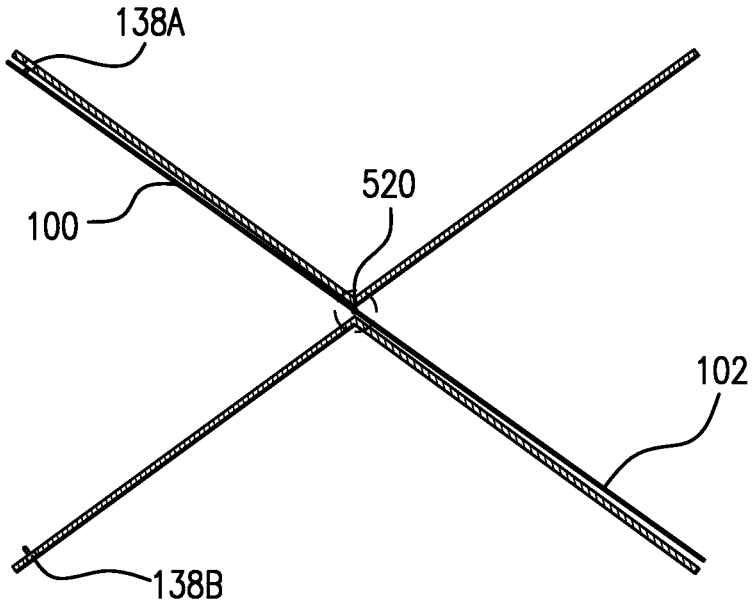
FIG. 3 is a side view of the expansion-compression device in a first condition.

The exemplary expansion and pre-compression driven thereby is obtained via appropriate timing of the opening and closing of the various valves 94 and 96. FIG. 3 shows a first terminal condition wherein the first and third chambers 80A and 80C are in their minimum volume states. As is discussed further below, during operation, at the point of reaching this state (or shortly therebefore), the valves are in closed (C) or open (O) conditions of Condition One in Table I below:

TABLE I

| Valve | Valve | | | | | | | |
|---|---|---|---|---|---|---|---|---|
| Condition | 94A | 96A | 94B | 96B | 94C | 96C | 94D | 96D |
| Condition One | C | O | O | C | C | O | O | C |
| Condition Two | O | C | C | O | O | C | C | O |

Figure 4:
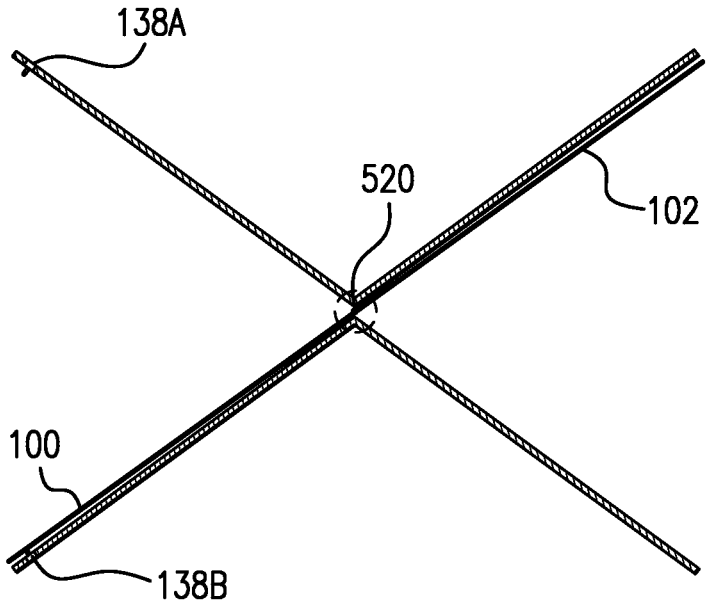
FIG. 4 is a side view of the expansion-compression device in a second condition.

The valves are then shifted to Condition Two. Condition Two exposes: chamber 80A to the discharge of the heat rejection heat exchanger 30; chamber 80B to the inlet 62 to the heat absorption heat exchanger 60; chamber 80C to the outlet 64 of the heat absorption heat exchanger; and chamber 80D to the compressor suction port 24. The first chamber is thus at the high side pressure P1 and the second chamber is thus at the low side pressure P2. This pressure difference drives the pivoting member counterclockwise as refrigerant flows into the chamber 80A and refrigerant flows out of the chamber 80B. The driving by the first side 42 tends to compress refrigerant in the fourth chamber 80D raising its pressure to the compressor suction pressure P3. Eventually, the pivoting member reaches its second terminal condition (FIG. 4) wherein the first 80A and third 80C chambers are at their maximum volumes and the second 80B and fourth 80D chambers are at their minimum volumes. To reverse the pivoting of the pivoting member, the valves are switched back to Condition One of Table I and the functions of the first and second chambers are reversed and the functions of the third and fourth chambers are reversed. To control switching of the valves, one or more sensors 138 are provided to effectively determine the position of the pivoting member. FIG. 1 shows first and second such sensors 138A and 138B respectively as switches which are respectively triggered in the first terminal condition and the second terminal condition. Alternative sensors 138 are pressure sensors to provide sensor output used by the control system to control valve switching.

In a basic implementation, the controller detects triggering of the first sensor 138A to switch the valves from the first condition of Table I to the second condition of Table I. Similarly, triggering of the second sensor 138B causes the controller to switch the valves from Condition Two back to Condition One.

An exemplary use involves a commercial refrigeration system wherein the heat absorption heat exchanger is in a refrigerated compartment or in recirculating airflow communication therewith. The heat rejection heat exchanger is external to the refrigerated compartment and not in airflow communication therewith. The commercial refrigeration system may be a single self-contained refrigerated unit or may involve one or more remote heat rejection heat exchangers coupled to one or more heat absorption heat exchangers.

In general, appropriate known or yet-developed materials, components, and manufacturing techniques may be used. Exemplary bellows materials include welded metals (e.g., stainless steel). Flexible polymer materials (e.g., molded polymer bellows) may be used in relatively low pressure applications. An exemplary controller may be otherwise identical to a baseline controller for control of various system components but additionally programmed to actuate the valves between the conditions discussed above.

More complicated arrangements are possible. For example, various modifications to valve timing may be made. In one example, valve conditions are switched slightly before each terminal position is reached. This may reduce mechanical noise and loading. This may be achieved by slight repositioning of the sensors so as to be triggered before the terminal position is reached. Alternatively, a more versatile sensor (e.g., a continuous position sensor rather than switches) may be used. In yet further implementations, various of the valves may be opened or closed with slight offset to achieve appropriate benefits.

In yet further modifications, the valves might be purely mechanically opened and closed responsive to position of the pivoting member. For example, the pivoting member may be coupled by one or more mechanical linkages to the valves.

Figure 5:
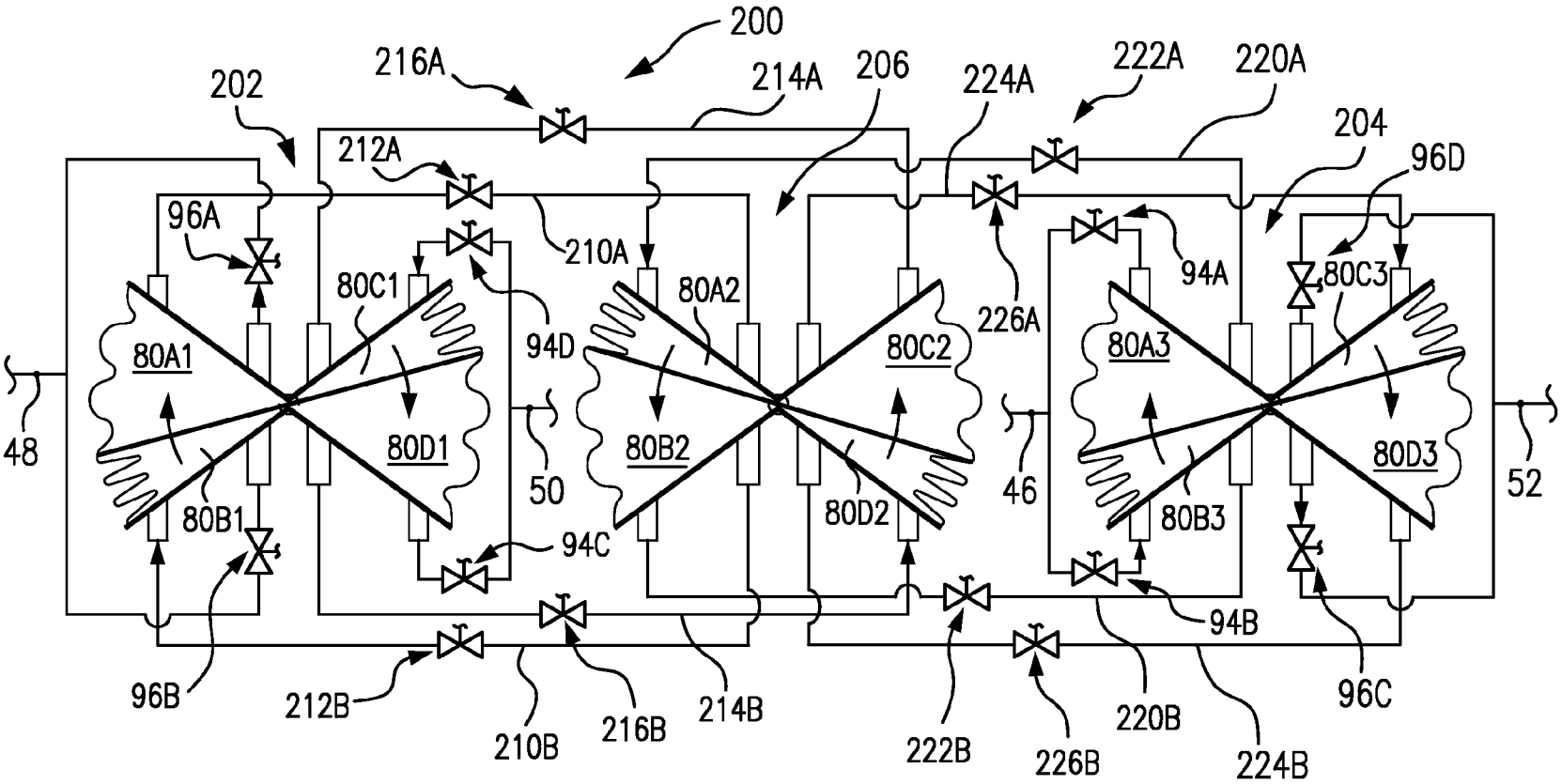
FIG. 5 is a view of a series of individual expansion-compression devices forming an overall expansion-compression device in a first condition.

FIG. 5 shows a series of individual expansion devices forming a larger overall expansion-compression device 200. Each individual expansion-compression device may be similar to the expansion-compression device 40. The device of FIG. 1 alternatively couples the ports 46 and 48 (and their associated condenser/gas cooler outlet and evaporator inlet) alternatingly to the respective chambers 80A and 80B at one side of a single device 40 and the ports 50 and 52 (and their respective evaporator outlet and compressor inlet conditions) to the chambers at the other side. The exemplary series of devices in FIG. 5 includes a first device 202 and a second device 204. The third device 206 is used to couple the first and second devices. The port 48 is alternatively coupled to the chambers on the first side of the first expansion device. Accordingly, in the identified implementation, the same numbers 96A and 96B are used for the associated valves. The port 50 similarly remains alternatively coupled to the chambers on the opposite side of the first device 202. However, rather than being associated with the first device, the ports 46 and 52 are similarly associated with the second device 204. Thus, the exemplary system 200 associates the low side with the first device 202 and the high side with the second device 204. The one or more intermediate devices (e.g. the single illustrated device 206) may be used to couple the first device 202 and second device 204. To provide the exemplary coupling, a pair of lines/conduits 210A and 210B couple the chambers on the first sides of the first device 202 and third device 206. For example, the conduits 210A couple the first chambers and the conduits 210B couple the second chambers. The conduits 210A and 210B bear respective valves 212A and 212B. A second pair of conduits 214A and 214B respectively couple the chambers on the second sides of the first and third devices. The lines 214A and 214B bear respective valves 216A and 216B. A similar coupling is provided between the second device 204 and the third device 206. A first pair of lines 220A and 220B bearing respective valves 222A and 222B respectively couple the first and second chambers of the first sides of the devices 204 and 206. A second pair of lines 224A and 224B bearing respective valves 226A and 226B couple the first and second chambers on the first and second sides.

Table II shows a valve state diagram additive to that of Table I for the device 200.

TABLE II

| Valve | Valve | | | | | | | |
|---|---|---|---|---|---|---|---|---|
| Condition | 212A | 212B | 216A | 216B | 222A | 222B | 226A | 226B |
| Condition One | C | O | C | O | O | C | C | O |
| Condition Two | O | C | O | C | C | O | O | C |

The rotation of the walls 100, 102 is driven by relative pressure. Tables III and IV respectively show one rough example of non-dimensionalized pressure values for the system of FIGS. 5 and 6. Reference is made to the system as viewed in FIG. 5 with net non-dimensionalized pressure difference values across each wall and non-dimensionalized net torque (simplified as the combined pressure difference) being identified as either clockwise or counterclockwise as viewed. As is discussed further below, various system parameters may be designed, in view of anticipated thermodynamic conditions, to provide sufficient torque to drive the rotation but not so much torque as to be damaging or inefficient.

TABLE III

| | Beginning of FIG. 5 Stroke | | | End of FIG. 5 Stroke | | |
|---|---|---|---|---|---|---|
| Chamber | Pressure | Pressure Difference | Net Torque | Pressure | Pressure Difference | Net Torque |
| 80A1 | 50 | 25 | 50 | 75 | 25 | 25 |
| 80B1 | 75 | Clockwise | Clockwise | 50 | Counter-clockwise | Counter-clockwise |
| 80C1 | 100 | 25 | | 75 | 0 | |
| 80D1 | 75 | Clockwise | | 75 | | |
| 80A2 | 50 | 25 | 50 | 25 | 25 | 25 |
| 80B2 | 25 | Counter-clockwise | Counter-clockwise | 50 | Clockwise | Clockwise |
| 80C2 | 50 | 25 | | 50 | 0 | |
| 80D2 | 75 | Counter-clockwise | | 50 | | |
| 80A3 | 0 | 25 | 50 | 25 | 25 | 25 |
| 80B3 | 25 | Clockwise | Clockwise | 0 | Counter-clockwise | Counter-clockwise |
| 80C3 | 50 | 25 | | 25 | 0 | |
| 80D3 | 25 | Clockwise | | 25 | | |

TABLE IV

Figure 6:
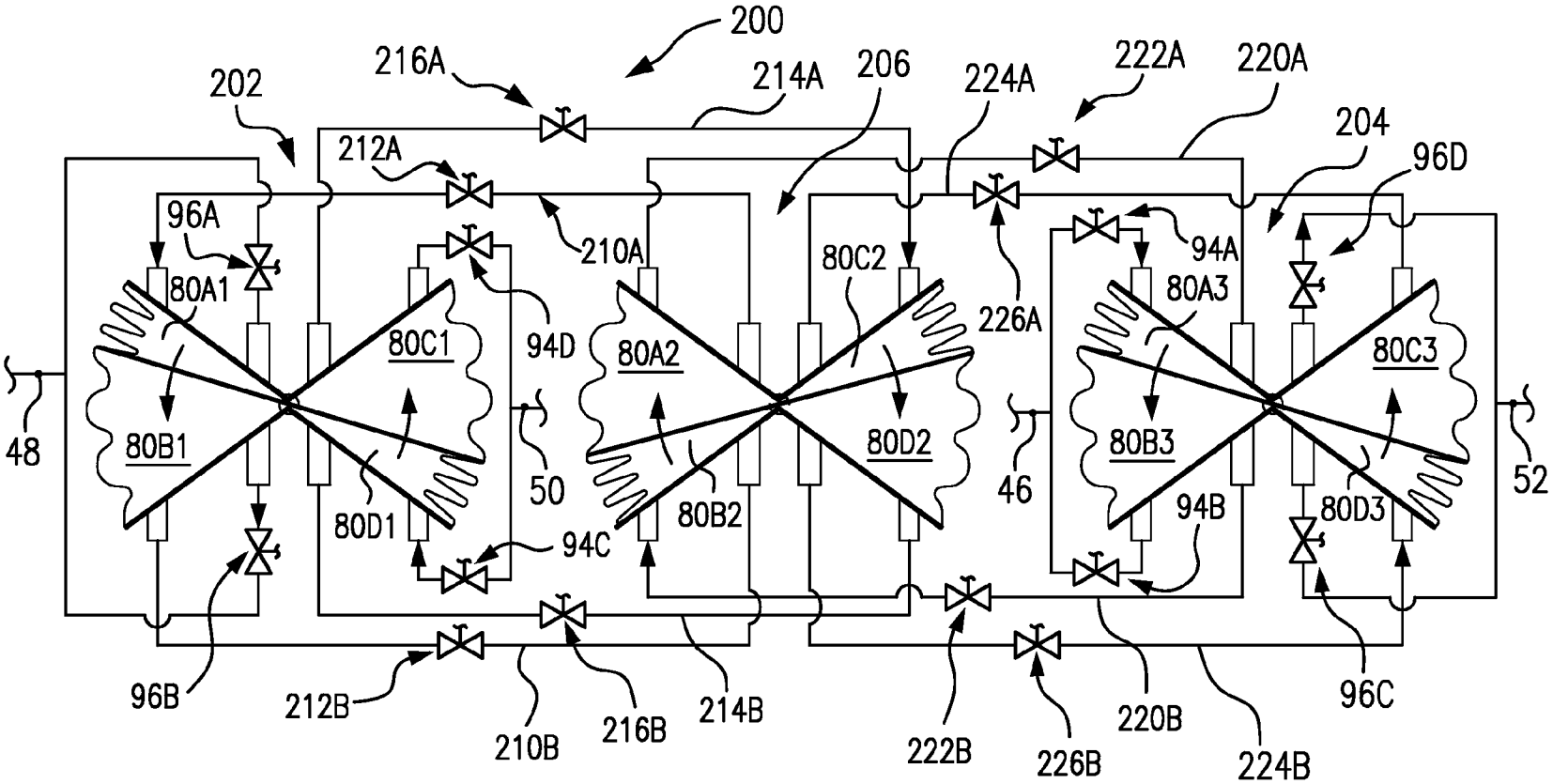
FIG. 6 is a view of the overall expansion-compression device of FIG. 5 in a second condition.

| | Beginning of FIG. 6 Stroke | | | End of FIG. 6 Stroke | | |
|---|---|---|---|---|---|---|
| Chamber | Pressure | Pressure Difference | Net Torque | Pressure | Pressure Difference | Net Torque |
| 80A1 | 75 | 25 | 25 | 50 | 25 | 50 |
| 80B1 | 50 | Counter-clockwise | Counter-clockwise | 75 | Clockwise | Clockwise |
| 80C1 | 75 | 0 | | 100 | 25 | |
| 80D1 | 75 | | | 75 | Clockwise | |
| 80A2 | 25 | 25 | 25 | 50 | 25 | 50 |
| 80B2 | 50 | Clockwise | Clockwise | 25 | Counter-clockwise | Counter-clockwise |
| 80C2 | 50 | 0 | | 50 | 25 | |
| 80D2 | 50 | | | 75 | Counter-clockwise | |
| 80A3 | 25 | 25 | 25 | 0 | 25 | 50 |
| 80B3 | 0 | Counter-clockwise | Counter-clockwise | 25 | Clockwise | Clockwise |
| 80C3 | 25 | 0 | | 50 | 25 | |
| 80D3 | 25 | | | 25 | Clockwise | |

Similar control parameters may be used to add yet further stages. The use of two, three, or more interconnected expansion-compression devices may allow for more efficient utilization (more steps can yield greater equilibration to use more of the available energy) and/or greater overall pressure differences compared with a single expansion-compression device. The number of devices may be selected based upon diminishing cost efficiency (theoretical efficiency gains minus cost of added hardware and any frictional losses from added hardware).

Figures 7, 8, 9:
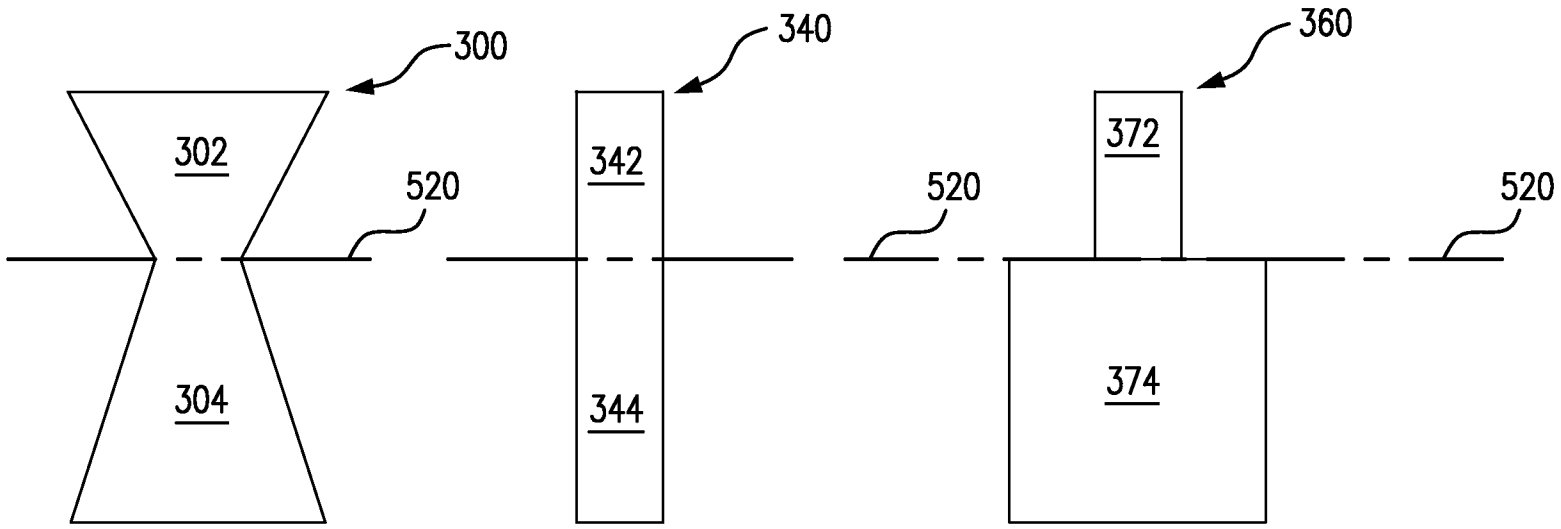
FIG. 7 is a plan view of the profile of a first alternate expansion device.
FIG. 8 is a plan view of the profile of a second alternate expansion device.
FIG. 9 is a plan view of the profile of a third alternate expansion device.

Whereas the previously-illustrated embodiments are symmetric side-to-side, they may be asymmetric with the size, shape, and/or position of the chamber used for expansion differing from those used for compression. The particular asymmetry may depend upon the thermo-physical properties refrigerant. For example, FIGS. 7, 8, and 9 are planform views of devices 300, 340, 370 showing relatively smaller walls and chambers 302, 342, 372 on one side of the hinge axis than walls and chambers 304, 344, 374 on the other side. A first impression of relative size may be gathered by looking at the planform area on the two sides. However, the swept volume is a more relevant parameter. The swept volume reflects not merely the planform area of the chamber but its radial position distribution relative to the hinge axis in view of the angle swept during operation. The swept volume may be selected to equal the desired change in volume of the working fluid. In addition to determining the appropriate swept volume(s), torque on either side of the hinge should balance sufficiently to provide a desired smoothness of rotation and efficiency. To obtain torque balance, the pressure within each chamber is integrated with the radius from the hinge axis over the planform area of such chamber so as to cancel. The geometry may be optimized to provide a desired degree of balance over a desired target operating range.

Figure 10:
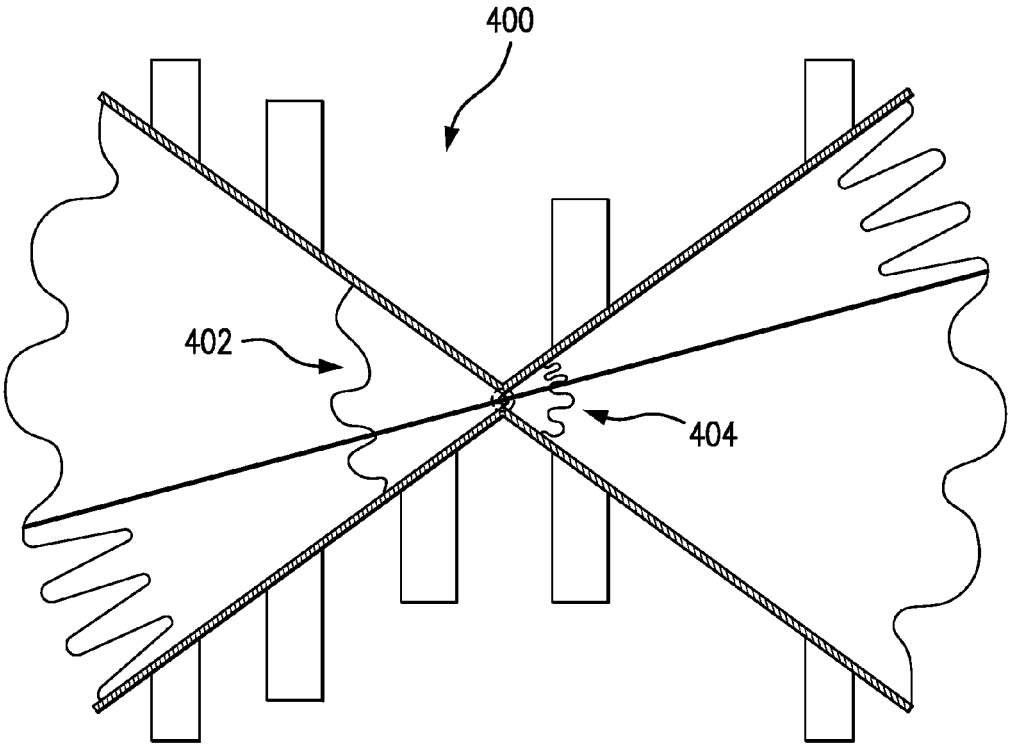
FIG. 10 is a side view of an expansion-compression device with inboard bellows sections.

To provide such torque balancing, it may be particularly relevant to provide an inner bellows or other means. FIG. 10 shows a device 400 with inner bellows 402, 404 isolating the hinge from the chambers. Although such inner bellows may generically be used to isolate the chambers by positioning the bellows for each side at a different radius from the hinge axis 520, an additional degree of freedom is provided to be used for providing the desired chamber volumes with torque balance.

One or more embodiments have been described. Nevertheless, it will be understood that various modifications may be made. For example, when implemented in the remanufacturing of an existing system or the reengineering of an existing system configuration, details of the existing configuration may influence or dictate details of any particular implementation. Accordingly, other embodiments are within the scope of the following claims.

What is claimed is:

1. An apparatus (20) comprising:
- a compressor (22) having a suction port (24) and a discharge port (26);
- a heat rejection heat exchanger (30);
- a heat absorption heat exchanger (60); and
- at least one expansion-compression device (40; 200) coupling the heat absorption heat exchanger to the heat rejection heat exchanger and to the compressor and comprising:
  - a pivoting member (98) mounted for reciprocal rotation in opposite first and second directions about an axis;
  - a first variable volume chamber (80A) having an associated first wall formed by a first side of a first portion of the pivoting member;
  - a second variable volume chamber (80B) having an associated second wall formed by a second side of the first portion of the pivoting member;
  - a third variable volume chamber (80C) having an associated third wall formed by a first side of a second portion of the pivoting member; and
  - a fourth variable volume chamber (80D) having an associated fourth wall formed by a second side of the second portion of the pivoting member,
  - the expander apparatus having an asymmetric construction wherein the respective first and second walls of the first and second chambers differ in size, shape, and/or distance of the chamber from the axis from the respective third and fourth walls of the third and fourth chambers,
  - wherein the pivoting member (98) is coupled to the chambers so that:
    - rotation from the initial orientation in the first direction expands the first and third chambers and compresses the second and fourth chambers; and
    - rotation from the initial orientation in the second direction compresses the first and third chambers and expands the second and fourth chambers.

2. The apparatus of claim 1 wherein the expansion-compression device further comprises, for each of the chambers:
- a first port (90A-90D) and a second port (92A-92D);
- a first valve (94A-94D) positioned to control flow through the first port; and
- a second valve (96A-96D) positioned to control flow through the second port.

3. The apparatus of claim 1 wherein:
- the at least one expansion-compression device comprises at least two such expansion-compression devices;
- a first said expansion-compression device (202) has a first side coupled to the inlet of the heat absorption heat exchanger and a second side coupled to the outlet of the heat absorption heat exchanger;
- a second said expansion-compression device (204) has a first side coupled to the outlet of the heat rejection heat exchanger and a second side coupled to the suction port of the compressor; and
- the first expansion-compression device and second expansion-compression device are coupled to each other.

4. The apparatus of claim 3 wherein:
- the first expansion-compression device (202) and the second expansion-compression device (204) are coupled to each other via at least one intervening expansion-compression device (206).

5. The apparatus of claim 1 further comprising:
- a controller (140) programmed to alternatingly switch the apparatus between a first condition associated with said rotation from the initial orientation in the first direction and a second condition associated with a rotation in the second direction toward the initial orientation.

6. The apparatus of claim 1 wherein the expansion-compression device further comprises, for each of the chambers
- a fixed wall (82A-82D); and
- a bellows (86A-86D) cooperating with the fixed wall and the pivoting member to surround the associated chamber volume.

7. With the apparatus of claim 1, a method comprising, in at least a first mode:
- running the compressor; and
- alternatingly switching between:
  - a first condition wherein:
    - refrigerant passes from the heat rejection heat exchanger to the first chamber;
    - refrigerant passes from the second chamber to the heat absorption heat exchanger;
    - refrigerant passes from the heat absorption heat exchanger to the third chamber;
    - refrigerant passes from the fourth chamber to the compressor; and
  - a second condition wherein:
    - refrigerant passes from the heat rejection heat exchanger to the second chamber;
    - refrigerant passes from the first chamber to the heat absorption heat exchanger;
  - refrigerant passes from the heat absorption heat exchanger to the fourth chamber; and
  - refrigerant passes from the third chamber to the compressor.

8. The method of claim 7 wherein, in the first mode, a pressure difference ($\Delta P_E$) across the expansion-compression device between the heat absorption heat exchanger and the compressor is at least 5% of a pressure difference ($\Delta P$) between the heat rejection heat exchanger and the heat absorption heat exchanger.

9. The apparatus of claim 1 wherein:

each of the chambers is formed as a hinged bellows structure.

10. The apparatus of claim 9 wherein each bellows structure includes bellows material along a distal end and two lateral sides.

11. The apparatus of claim 10 wherein each bellows structure includes a proximal bellows material isolating the hinge.

* * * * *